United States Patent [19]

Nakamura et al.

[11] 4,420,538

[45] Dec. 13, 1983

[54] HEAT-SENSITIVE RECORDING MATERIALS

[75] Inventors: Teruo Nakamura, Nishinomiya; Naoto Arai, Ikeda, both of Japan

[73] Assignee: Murata Manufacturing Co., Ltd., Kyoto, Japan

[21] Appl. No.: 336,174

[22] Filed: Dec. 31, 1981

[30] Foreign Application Priority Data

Jan. 13, 1981 [JP] Japan ..... 56-4738

[51] Int. Cl.[3] ..... B41M 5/18

[52] U.S. Cl. ..... 428/411; 282/27.5; 427/150; 427/151; 428/320.8; 428/488; 428/537; 428/913

[58] Field of Search ..... 427/150, 151; 282/27.5; 428/320.4, 320.6, 320.8, 411, 488, 537, 913, 914

[56] References Cited

U.S. PATENT DOCUMENTS 3,244,550 4/1966 Farnham et al. ..... 106/22
3,846,153 11/1974 Futaki et al. ..... 117/36.9
4,312,522 1/1982 Yamaguchi et al. ..... 282/27.5

FOREIGN PATENT DOCUMENTS 57-107883 7/1982 Japan ..... 282/27.5

*Primary Examiner*—Bruce H. Hess
*Attorney, Agent, or Firm*—Finnegan, Henderson, Farabow, Garrett & Dunner

[57] ABSTRACT

A heat-sensitive recording material is described comprising a support having a recording layer provided thereon, said recording layer containing (1) at least one colorless or pale-colored basic dye, (2) hydroquinone monobenzyl ether, and (3) at least one compound selected from compounds represented by the formulae (I) to (IV):

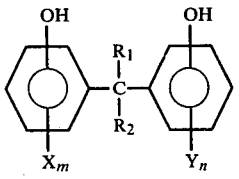

(I)

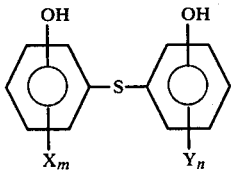

(II)

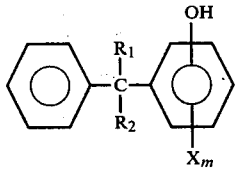

(III)

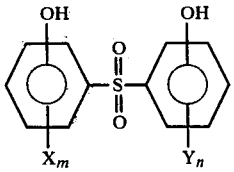

(IV)

wherein X and Y are each a chlorine atom, an alkyl group having 1 to 7 carbon atoms, a phenyl group or a benzyl group; m and n are each an integer of 0 to 3; and $R_1$ and $R_2$ are each a hydrogen atom, an alkyl group having 1 to 7 carbon atoms, a phenyl group or a benzyl group, or $R_1$ and $R_2$ may jointly form a cyclohexane ring. The heat-sensitive recording material is suitable for use in high-speed recording, e.g., high-speed facsimiles.

9 Claims, No Drawings

HEAT-SENSITIVE RECORDING MATERIALS

FIELD OF THE INVENTION

The present invention relates to heat-sensitive recording materials, and more particularly, to heat-sensitive recording materials which are suitable for use in high-speed recording and can provide recorded images which are resistant to fading.

BACKGROUND OF THE INVENTION

Heretofore, heat-sensitive recording materials have been well known, in which colorless or pale-colored basic dyes and organic or inorganic color formers are brought into contact with each other by application of heat to produce recorded images by utilizing the color reaction therebetween.

Recent remarkable advances in heat-sensitive recording systems have permitted high-speed operation of all apparatus utilizing a thermal head, such as heat-sensitive facsimiles and heat-sensitive printers. For example, modern heat-sensitive facsimiles can transmit a printed page of A4 size paper (210×297 mm) in 20 seconds, and modern heat-sensitive printers can print 120 or more letters per second. With development of such high-speed facsimiles and printers, it is now required for heat-sensitive recording materials which are used in the high-speed facsimiles and printers to have a high recording sensitivity (dynamic recording characteristics), cause no static recording within a low temperature range (60° C. to 70° C.), and to cause no piling due to attachment of tailings.

Some conventional high sensitivity heat-sensitive recording materials are prepared using combinations of dyes, phenol compounds such as bisphenol A, and sensitizers such as stearic acid amide. In a recording layer of such high sensitivity heat-sensitive recording materials, the sensitizer and phenol compound are compounded in a proportion ranging between 2 and 5 per part by weight of the dye. These heat-sensitive recording materials, however, have disadvantages in that the so-called static recording within a low temperature range (60° C. to 70° C.) occurs as the recording sensitivity is increased, and the piling property is poor since a large amount of the sensitizer is added.

It has therefore been desired to develop heat-sensitive recording materials which are well-balanced in the quality thereof and are suitable for use in high-speed recording.

SUMMARY OF THE INVENTION

As a result of various investigations to develop heat-sensitive recording materials suitable for use in high-speed recording apparatus, and in particular, extensive studies on color formers, it has now been found that heat-sensitive recording materials prepared using hydroquinone monobenzyl ether are suitable for use in high-speed recording.

Although the exact reason why the use of hydroquinone monobenzyl ether is suitable for high-speed recording is not clear, it is believed that high sensitivity color-formation is attributable to the physical properties of hydroquinone monobenzyl ether that it shows sharp coloration when melted, since it has high crystallinity, and furthermore has a low melting point of about 120° C.

Since hydroquinone monobenzyl ether has the above-described physical properties, when it is used as a color former for heat-sensitive recording materials, it is not necessary to add sensitizers. This leads to a reduction in the amount of the materials to be melted for recording, and thus to the prevention of the piling phenomenon.

Although hydroquinone monobenzyl ether has the above-described characteristics, when used in combination with dyes, it exhibits thermochromism of coloration and decoloration at specific temperatures. Difficulties, therefore, are encountered in putting hydroquinone monobenzyl ether into practical use, as is, as a color former for heat-sensitive recording materials.

As a result of extensive studies to develop heat-sensitive materials which are free from the problem of decoloration of recorded images which is encountered in using hydroquinone monobenzyl ether in combination with dyes, and which permits hydroquinone monobenzyl ether to exhibit the excellent physical properties thereof as a color former, it has been found that such heat-sensitive materials can be prepared by using hydroquinone monobenzyl ether and colorless or pale-colored basic dyes in combination with compounds represented by the formulae (I) to (IV):

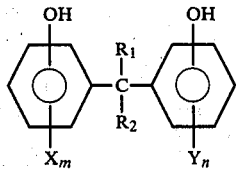

(I)

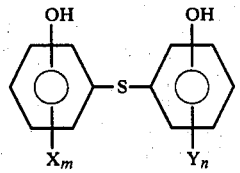

(II)

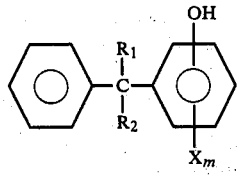

(III)

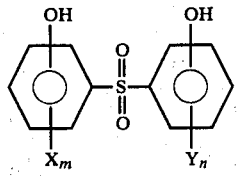

(IV)

wherein X and Y are each a chlorine atom, an alkyl group having 1 to 7 carbon atoms, a phenyl group or a benzyl group; m and n are each an integer of 0 to 3; and $R_1$ and $R_2$ are each a hydrogen atom, an alkyl group having 1 to 7 carbon atoms, a phenyl group or a benzyl group, or $R_1$ and $R_2$ may jointly form a cyclohexane ring.

The present invention, therefore, provides a heat-sensitive recording material comprising a support having a recording layer provided thereon, the recording layer containing (1) at least one colorless or pale-colored basic dye, (2) hydroquinone monobenzyl ether, and (3) at least one compound selected from the compounds represented by the above formulae (I) to (IV).

DETAILED DESCRIPTION OF THE INVENTION

Although the reason why the thermochromic properties of hydroquinone monobenzyl ether disappear when it is used in combination with a compound selected from those represented by the above formulae (I) to (IV) is not clear, it is believed that the decoloration of recorded images is probably caused by recrystallization of materials, which are melted on heating, undergo a color reaction, due to a reduction in temperature, and that the recrystallization is prevented by using the compounds represented by the above formulae (I) to (IV) in combination therewith.

Colorless or pale-colored basic dyes which can be used in the preparation of the recording layer of the heat-sensitive recording material of the present invention include triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes, e.g., 4,4'-bis-dimethylaminobenzhydryl-benzylether, N-halophenyl-leucoauramine, and N-2,4,5-trichlorophenylleucoaramine; thiazine-based dyes, e.g., benzoyl-leucomethyleneblue, and p-nitrobenzoyl-leucomethyleneblue; spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiropyran, and 3-propyl-spiro-dibenzopyran; lactam-based dyes, e.g., rhodamine-B-anilinolactam, rhodamine(p-nitroanilino)lactam, and rhodamine(o-chloroanilino)-lactam; and fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-N-p-toluidino)-7-methylfluoran, 3-diethylamino(7-acetylmethylamino)fluoran, 3-diethylamino(7-methylamino)-fluoran, 3-diethylamino-7-(dibenzylamino)fluoran, 3-diethylamino-7-(methylbenzylamino)fluoran, 3-diethylamino-7-(chloroethylmethylamino)fluoran, 3-diethylamino-7-diethylaminofluoran, 3-(N-ethyl-N-p-toluidino)-6-methyl-7-phenylaminofluoran, 3-(N-ethyl-N-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, and 3-pyrrolidino-6-methyl-7-p-butylphenylaminofluoran. The present invention is not limited to these exemplified basic dyes. These basic dyes can be used either alone or in admixture.

In the above formulae (I) to (IV), the substituents X and Y are each a chlorine atom, an alkyl group having 1 to 7 carbon atoms, a phenyl group or a benzyl group. Suitable examples of the alkyl group include straight or branched chain alkyl group, e.g., a methyl group, an ethyl group, a propyl group, a butyl group, a penyl group, a hexyl group and a heptyl group, and a cyclohexyl group, and suitable examples of the phenyl and benzyl group include an unsubstituted phenyl group and an unsubstituted benzyl group.

Furthermore, the substituents $R_1$ and $R_2$ are each a hydrogen atom, an alkyl group having 1 to 7 carbon atoms, a phenyl group or a benzyl group, or these may jointly form a cyclohexane ring. Suitable examples of the alkyl, phenyl and benzyl groups are the same as exemplified above for the substituents X and Y.

In the compounds represented by the formulae (I) to (IV), if the carbon atom number of the respective substituent exceeds 7, the melting point of the compounds per se becomes too low, and in the resulting recording materials, coloration (i.e., static recording) takes place in a low temperature region. Thus, such compounds are not useful in the present invention.

The compounds represented by the formulae (I) to (IV) can be used either alone or in admixture.

In practical uses, the compounds represented by the formulae (I) to (IV) are suitable selected by taking into account the melting point as well as affinity with the basic dyes and hydroquinone monobenzyl ether used. Typical compounds are listed below.

| | Melting Point (°C.) |
|---|---|
| Bis(4-hydroxyphenyl)methane | 160 |
| 1,1-Bis(4'-hydroxyphenyl)ethane | 120 |
| 2,2-Bis(4'-hydroxyphenyl)propane | 155 |
| 2,2-Bis(4'-hydroxyphenyl)butane | 120 |
| 2,2-Bis(4'-hydroxyphenyl)octane | 88 |
| 4,4'-Dihydroxy-triphenylmethane | 161 |
| 1,1-Bis(4'-hydroxyphenyl)cyclohexane | 175 |
| 1,1-Bis(3'-tert-butyl-4'-hydroxy-6'-methylphenyl)butane | 208 |
| Bis(3,5-di-tert-butyl-4-hydroxyphenyl)-methane | 154 |
| 2,2-Bis(3'-phenyl-4'-hydroxyphenyl)-propane | 98–100 |
| Bis(2-hydroxy-3-tert-butyl-5-methyl-phenyl)methane | 120 |
| Bis(2-hydroxy-3-tert-butyl-5-ethyl-phenyl)methane | 119 |
| (3'-Methyl-4',4''-dihydroxy-diphenyl)-2,2-propane | 114 |
| 2,2-Bis(3'-cyclohexyl-4'-hydroxy-phenyl)propane | 146 |
| Bis(2-hydroxy-5-chlorophenyl)methane | 175 |
| Bis(2-hydroxy-3,5,6-trichlorophenyl)-methane | 161 |
| Bis(4-hydroxyphenyl)sulfide | 152 |
| Bis(2-methyl-4-hydroxy-5-tert-butyl-phenyl)sulfide | 152 |
| Bis(3-methyl-4-hydroxy-5-tert-butyl-phenyl)sulfide | 124 |
| Bis(2-hydroxy-5-chlorophenyl)sulfide | 175 |
| Bis(2-hydroxy-3,5-dichlorophenyl)sulfide | 188 |
| 2,6-Di-tert-butyl-4-(α,α-di-methyl-benzyl)phenol | 73 |
| Bis(4-hydroxyphenyl)sulfone | 250 |
| (2,4'-Dihydroxy)diphenylsulfone | 170 |

Of these compounds, since those having a chlorine atom or atoms as the substituents X and Y tend to pale color the recording materials per se, those having no chlorine atom are particularly preferred.

The amount of hydroquinone monobenzyl ether added is from 100 to 700 parts by weight, and preferably from 150 to 400 parts by weight, per 100 parts by weight of the dye.

The amount of the compound or compounds represented by the above formulae is 1 to 200 parts by weight, and preferably from 10 to 150 parts by weight, per 100 parts by weight of the hydroquinone monobenzyl ether.

In preparing a coating composition containing the basic dye, hydroquinone monobenzyl ether, and the compound represented by one of the above formulae, water is generally used as a dispersion medium. For example, the compounds can be dispersed in water by the use of agitators and pulverizers, such as a ball mill, an attritor, or a sand mill to prepare a coating composition.

The coating composition usually contains a binder. Examples of such binders include starch, oxidized starch, esterified starch, etherified starch, other modified starches, hydroxyethyl cellulose, methyl cellulose, carboxymethyl cellulose, gelatin, casein, gum arabic, polyvinyl alcohol, styrene-maleic anhydride copolymer salts, styrene-acrylic acid copolymer salts, and styrene-butadiene copolymer emulsions. The amount of the binder used is generally from 10 to 40% by weight, and preferably from 15 to 30% by weight, based on the weight of the total solids. Additionally, the coating composition can contain various auxiliary agents.

Examples of such auxiliary agents are dispersants such as sodium dioctylsulfosuccinate, sodium dodecylbenzenesulfonate, sodium lauryl sulfate and fatty acid metal salts; ultraviolet absorbents such as benzophenone-based ultraviolet absorbents (e.g., 2,4-dihydroxybenzophenone and 2-hydroxy-4-benzyloxybenzophenone) and triazole-based ultraviolet absorbents (e.g., 2-(2'-hydroxy-5'-methylphenyl)benzotriazole, 2-(2'-hydroxy-3',5'-di-tert-butylphenyl)benzotriazole and 2-(2'-hydroxy-5'-tert-octylphenyl)benzotriazole); defoaming agents; fluorescent dyes; and coloring dyes.

Furthermore, in order that the heat-sensitive recording material does not produce sticking upon coming into contact with a recording head, dispersions or emulsions of stearic acid, polyethylene, carnauba wax, paraffin wax, zinc stearate, calcium stearate, and ester wax can be added to the coating composition. In order to reduce the attachment of tailings to a recording head, inorganic pigments such as kaolin, clay, talc, calcium carbonate, calcined clay, titanium oxide, activated clay, and oil-absorptive pigments (e.g., kieselguhr and fine granular anhydrous silica) can be added to the coating composition.

If desired, a stearic acid amide, a stearic acid methylenebisamide, an oleic acid amide, a palmitic acid amide, a sperm oleic acid amide, or a coconut fatty acid amide may be added as an auxiliary agent.

Supports which are used in the preparation of the heat-sensitive recording material of the invention include paper, a plastic film, a synthetic paper, and the like. Of these materials, paper is most preferably used in view of cost, coating suitability, and so forth.

Although the amount of the coating composition being coated on the support to prepare a recording layer is not critical, it is usually from 2 to 12 g/m$^2$, and preferably from 3 to 10 g/m$^2$, on a dry weight basis.

The heat-sensitive recording material of the invention is suitable for high-speed recording, and furthermore, it is free from the problem of decoloration of recorded images with a reduction in temperature and is excellent in a reduction of the attachment of tailings onto a recording head (piling).

The following Examples and Comparative Examples are given to illustrate the invention in greater detail although the invention is not limited thereto. All parts and percentages are by weight, unless otherwise indicated.

EXAMPLE 1

Preparation of Solution A

| | parts |
|---|---|
| 3-(N—Cyclohexyl-N—methylamino)-6-methyl-7-phenylaminofluoran | 10 |
| 5% Aqueous solution of methyl cellulose | 5 |
| Water | 40 |

These ingredients were pulverized by means of a sand mill to an average particle diameter measured by a Coulter Counter (MODEL-TA, made by Coulter Electronics Inc.) of 3 μm. (This pulverization method is common in all of the Examples and Comparative Examples.)

Preparation of Solution B

| | parts |
|---|---|
| Hydroquinone monobenzyl ether | 20 |
| 2,2-Bis(4'-hydroxyphenyl)propane | 10 |
| 5% Aqueous solution of methyl cellulose | 5 |
| Water | 85 |

These ingredients were pulverized to an average particle diameter of 3 μm.

Formation of Recording Layer

A mixture of 55 parts of Solution A, 120 parts of Solution B, 15 parts of fine granular anhydrous silica [oil absorption (measured according to JIS K5105: 180 ml/100 g], 50 parts of a 20% aqueous solution of oxidized starch, and 30 parts of water was stirred to prepare a coating composition. The coating composition was coated on a base paper of 50 g/m$^2$ such that the amount thereof after drying was 7 g/m$^2$, and dried to prepare a heat-sensitive recording paper.

EXAMPLE 2

Preparation of Solution A

| | parts |
|---|---|
| 3-(N—Ethyl-N—p-toluidino)-6-methyl-7-phenylaminofluoran | 10 |
| 5% Aqueous solution of methyl cellulose | 5 |
| Water | 40 |

These ingredients were pulverized to an average particle diameter of 3 μm.

Preparation of Solution B

| | parts |
|---|---|
| Hydroquinone monobenzyl ether | 20 |
| Bis(2-methyl-4-hydroxy-5-tert-butylphenyl)sulfide | 20 |
| 5% Aqueous solution of methyl cellulose | 5 |
| Water | 120 |

These ingredients were pulverized to an average particle diameter of 3 μm.

Formation of Recording Layer

A mixture of 55 parts of Solution A, 165 parts of Solution B, 25 parts of calcined clay, 75 parts of a 20% aqueous solution of oxidized starch, and 50 parts of water was stirred to prepare a coating composition. The coating composition was coated in the same manner as in Example 1 to prepare a heat-sensitive recording paper.

EXAMPLE 3

A heat-sensitive recording paper was prepared in the same manner as in Example 1, except that bis(2-hydroxy-3-tert-butyl-5-methylphenyl)methane was used in place of 2,2-bis(4'-hydroxyphenyl)propane in the preparation of Solution B.

EXAMPLE 4

A heat-sensitive recording paper was prepared in the same manner as in Example 2, except that 1,1-bis(4'-hydroxyphenyl)cyclohexane was used in place of bis(2-methyl-4-hydroxy-5-tert-butylphenyl)sulfide in the preparations of Solution B.

COMPARATIVE EXAMPLE 1

A heat-sensitive recording paper was prepared in the same manner as in Example 1, except that 2,2-bis(4'-hydroxyphenyl)propane was not used in the preparation of Solution B.

COMPARATIVE EXAMPLE 2

A heat-sensitive recording paper was prepared in the same manner as in Example 2, except that bis(2-methyl-4-hydroxy-5-tert-butylphenyl)sulfide was not used in the preparation of Solution B.

COMPARATIVE EXAMPLE 3

A heat-sensitive recording paper was prepared in the same manner as in Example 1, except that hydroquinone monobenzyl ether was not used but 30 parts (total) of 2,2-bis(4'-hydroxyphenyl)propane was used in the preparation of Solution B.

EXAMPLE 5

Preparation of Solution A

| | parts |
|---|---|
| 3-(N—Cyclohexyl-N—methylamino)-6-methyl-7-phenylaminofluoran | 6 |
| 3-(N—Ethyl-N—p-toluidino)-6-methyl-7-phenylaminofluoran | 4 |
| 5% Aqueous solution of methyl cellulose | 5 |
| Water | 40 |

These ingredients were pulverized to an average particle diameter of 3 μm.

Preparation of Solution B

| | parts |
|---|---|
| Hydroquinone monobenzyl ether | 20 |
| 1,1-Bis(4'-hydroxyphenyl)ethane | 10 |
| 5% Aqueous solution of methyl cellulose | 5 |
| Water | 85 |

These ingredients were pulverized to an average particle diameter of 3 μm.

Formation of Recording Layer

A mixture of 55 parts of Solution A, 120 parts of Solution B, 15 parts of fine granular anhydrous silica [oil absorption (measured according to JIS K5101): 180 ml/100 g], 50 parts of a 20% aqueous solution of oxidized starch, and 30 parts of water was stirred to prepare a coating composition. The coating composition was coated on a base paper of 50 g/m$^2$ such that the amount thereof after drying was 7 g/m$^2$, and dried to prepare a heat-sensitive recording paper.

EXAMPLE 6

A heat-sensitive recording paper was prepared in the same manner as in Example 1, except that 2,2-bis(4'-hydroxyphenyl)butane was used in place of 2,2-bis(4'-hydroxyphenyl)propane in the preparation of Solution B.

EXAMPLE 7

A heat-sensitive recording paper was prepared in the same manner as in Example 1, except that a mixture of 5 parts of 3-(N-cyclohexyl-N-methylamino)-6-methyl-7-phenylaminofluoran and 5 parts of 3-(N-ethyl-N-p-toluidino)-6-methyl-7-(p-toluidino)fluoran was used in place of 10 parts of 3-(N-cyclohexyl-N-methylamino)-6-methyl-7-phenylaminofluoran in the preparation of Solution A, and 2,2-bis(4'-hydroxyphenyl)octane was used in place of 2,2-bis(4'-hydroxyphenyl)propane in the preparation of Solution B, respectively.

EXAMPLE 8

A heat-sensitive recording paper was prepared in the same manner as in Example 5, except that (3'-methyl-4',''-dihydroxy-diphenyl)-2,2-propane was used in place of 1,1-bis(4'-hydroxyphenyl)ethane in the preparation of Solution B.

EXAMPLE 9

A heat-sensitive recording paper was prepared in the same manner as in Example 1, except that bis(2-hydroxy-5-chlorophenyl)methane was used in place of 2,2-bis(4'-hydroxyphenyl)propane in the preparation of Solution B.

EXAMPLE 10

A heat-sensitive recording paper was prepared in the same manner as in Example 1, except that 2,6-di-tert-butyl-4-(α,α-di-methylbenzyl)phenol was used in place of 2,2-bis(4'-hydroxyphenyl)propane in the preparation of Solution B.

EXAMPLE 11

A heat-sensitive recording paper was prepared in the same manner as in Example 2, except that bis(4-hydroxyphenyl)sulfone was used in place of bis(2-methyl-4-hydroxy-5-tert-butylphenyl)sulfide in the preparation of Solution B.

Using the heat-sensitive papers prepared in the above Examples 1 to 11 and Comparative Examples 1 to 3, recording was conducted with a heat-sensitive facsimile apparatus (Model KB-4800, made by Tokyo Shibaura Electric Company Limited). The color density of the thus-obtained recorded images was measured using a Macbeth reflection densitomer (Model RD-100R; an amber filter was used) to obtain a color density (a) immediately after the recording. Based on this color density (a) the recording sensitivity was evaluated in the following criterion.

AA: 1.1 or higher
A: higher than 0.9 but lower than 1.1
B: 0.9 or lower

The results are shown in the table below.

Further, the heat-sensitive recording papers were allowed to stand at room temperature (i.e., 25° C.) for 24 hours, and the color density of the areas at which the color density immediately after the recording had been measured as above was again measured to obtain a color density (b). Reduction in color density (i.e., degree of decoloration) was calculated by the following equation:

$$\text{Degree of Decoloration} = \frac{a-b}{a} \times 100\ (\%)$$

The degree of decoloration was evaluated in the following criterion.
X: lower than 10%
Y: 10% or higher The results are also shown in the table below.

TABLE

| | Recording Sensitivity | Degree of Decoloration |
|---|---|---|
| Example 1 | AA | X |
| Example 2 | AA | X |
| Example 3 | A | X |
| Example 4 | A | X |
| Comparative Example 1 | AA | Y |
| Example 2 | A | Y |
| Example 3 | B | Y |
| Example 5 | AA | X |
| Example 6 | AA | X |
| Example 7 | AA | X |
| Example 8 | AA | X |
| Example 9 | A | X |
| Example 10 | A | X |
| Example 11 | AA | X |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having a recording layer provided thereon, said recording layer containing (1) at least one colorless or pale-colored basic dye, (2) hydroquinone monobenzyl ether, and (3) at least one compound selected from compounds represented by the formulae (I) to (IV);

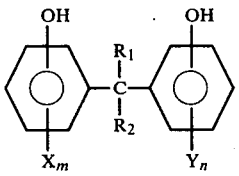

(I)

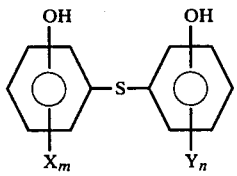

(II)

-continued

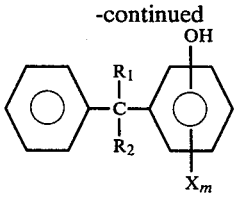

(III)

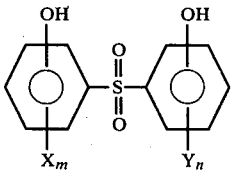

(IV)

wherein X and Y are each a chlorine atom, an alkyl group having 1 to 7 carbon atoms, a phenyl group or a benzyl group; m and n are each an integer of 0 to 3; and $R_1$ and $R_2$ are each a hydrogen atom, an alkyl group having 1 to 7 carbon atoms, a phenyl group or a benzyl group, or $R_1$ and $R_2$ may jointly form a cyclohexane ring.

2. A heat-sensitive recording material as in claim 1, wherein X and Y are each an alkyl group having 1 to 7 carbon atoms, a phenyl group or a benzyl group.

3. A heat-sensitive recording material as in claim 1 or 2, wherein the amount of hydroquinone monobenzyl ether used is from 100 to 700 parts by weight per 100 parts by weight of the basic dye.

4. A heat-sensitive recording material as in claim 1 or 2, wherein the amount of compound represented by the formulae (I) to (IV) is from 1 to 200 parts by weight per 100 parts by weight of hydroquinone monobenzyl ether.

5. A heat-sensitive recording material as in claim 1 or 2, wherein the amount of hydroquinone monobenzyl ether used is from 150 to 400 parts by weight per 100 parts by weight of the basic dye.

6. A heat-sensitive recording material as in claim 1 or 2, wherein the amount of compound represented by the formulae (I) to (IV) is from 10 to 150 parts by weight per 100 parts by weight of hydroquinone monobenzyl ether.

7. A heat-sensitive recording material as in claim 1 or 2, wherein the amount of hydroquinone monobenzyl ether used is from 100 to 700 parts by weight per 100 parts by weight of the basic dye, and the amount of compound represented by the formulae (I) to (IV) is from 1 to 200 parts by weight per 100 parts by weight of hydroquinone monobenzyl ether.

8. A heat-sensitive recording material as in claim 1 or 2, wherein the amount of hydroquinone monobenzyl ether used is from 150 to 400 parts by weight per 100 parts by weight of the basic dye, and the amount of compound represented by the formulae (I) to (IV) is from 10 to 150 parts by weight per 100 parts by weight of hydroquinone monobenzyl ether.

9. The heat-sensitive recording material of claim 1 wherein said at least one compound is selected from the group consisting of 2,2-Bis(4'-hydroxyphenyl)propane, Bis (2-methyl-4-hydroxy-5-tertbutylphenyl)sulfide, Bis(2-hydroxy-3-tert-butyl-5-methylphenyl)methane, 1,1-bis(4'-hydroxyphenyl)cyclohexane, 1,1-Bis(4'-hydroxyphenyl)ethane, 2,2-bis(4'-hydroxyphenyl)butane, 2,2-bis(4'-hydroxyphenyl)octane, (3'-methyl-4',4''-dihydroxydiphenyl)-2,2-propane, bis(2-hydroxy-5-chlorophenyl)methane, 2,6-di-tert-butyl-4-(α,α-dimethylbenzyl)phenol and bis(4-hydroxyphenyl)sulfone.

* * * * *

UNITED STATES PATENT AND TRADEMARK OFFICE

CERTIFICATE OF CORRECTION

PATENT NO. : 4,420,538

DATED : December 13, 1983

INVENTOR(S) : Teruo Nakamura, Nishinomiya; Naoto Arai, Ikeda

It is certified that error appears in the above—identified patent and that said Letters Patent is hereby corrected as shown below:

On the face of the patent "Murata Manufacturing Co., Ltd.," should be -- Kanzaki Paper Mfg. Co., Ltd. --

Signed and Sealed this

*Fourteenth* Day of *August 1984*

[SEAL]

*Attest:*

GERALD J. MOSSINGHOFF

*Attesting Officer*

*Commissioner of Patents and Trademarks*